US010658764B2

(12) United States Patent
Shi et al.

(10) Patent No.: US 10,658,764 B2
(45) Date of Patent: May 19, 2020

(54) FEEDING NETWORK OF DUAL-BEAM ANTENNA AND DUAL-BEAM ANTENNA

(71) Applicant: HUAWEI TECHNOLOGIES CO., LTD., Shenzhen, Guangdong (CN)

(72) Inventors: Weiguang Shi, Shenzhen (CN); Zhiqiang Liao, Shenzhen (CN); Xinneng Luo, Dongguan (CN); Tao Guan, Shenzhen (CN)

(73) Assignee: HUAWEI TECHNOLOGIES CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/007,165

(22) Filed: Jun. 13, 2018

(65) Prior Publication Data

US 2018/0294577 A1 Oct. 11, 2018

Related U.S. Application Data

(63) Continuation of application No. PCT/CN2016/109551, filed on Dec. 13, 2016.

(30) Foreign Application Priority Data

Dec. 14, 2015 (CN) ..... 2015 1 0923138

(51) Int. Cl.
*H01Q 21/24* (2006.01)
*H01P 5/22* (2006.01)
(Continued)

(52) U.S. Cl.
CPC ..... *H01Q 21/24* (2013.01); *H01P 1/184* (2013.01); *H01P 5/187* (2013.01); *H01P 5/22* (2013.01);
(Continued)

(58) Field of Classification Search
CPC ..... H01Q 21/24; H01Q 1/002; H01Q 1/48; H01Q 21/0075
See application file for complete search history.

(56) References Cited

U.S. PATENT DOCUMENTS 6,333,683 B1 12/2001 Hampel
2013/0278461 A1 10/2013 Ai et al.
2018/0062258 A1 3/2018 Timofeev et al.

FOREIGN PATENT DOCUMENTS

CN 1553725 A 12/2004
CN 101707497 A 5/2010
(Continued)

OTHER PUBLICATIONS

Chia-Chan Chang et al., "Design of a Beam Switching/Steering Butler Matrix for Phased Array System," IEEE Transactions on Antennas and Propagation, vol. 58, No. 2, Feb. 2010, XP11298043A, pp. 367-374.

(Continued)

*Primary Examiner* — Graham P Smith
(74) *Attorney, Agent, or Firm* — Womble Bond Dickinson (US) LLP

(57) ABSTRACT

A feeding network of a dual-beam antenna and a dual-beam antenna are disclosed. The feeding network includes: a cavity, including an upper grounding metal plate and a lower grounding metal plate; a printed circuit board PCB, disposed inside the cavity, where a splitting network circuit and a phase-shift circuit in the feeding network are integrated into the PCB, and arrangement of the PCB and the cavity enables a wire on the PCB to have a strip line structure as a whole; and at least two radio-frequency signal input ports, where the at least two radio-frequency signal input ports are connected to the splitting network circuit on the PCB.

18 Claims, 5 Drawing Sheets

(51) Int. Cl.

| | |
|---|---|
| ***H01P 1/18*** | (2006.01) |
| ***H01P 5/18*** | (2006.01) |
| ***H01Q 25/00*** | (2006.01) |
| ***H01Q 1/52*** | (2006.01) |
| ***H01Q 3/40*** | (2006.01) |
| ***H01Q 1/00*** | (2006.01) |
| ***H01Q 1/48*** | (2006.01) |
| ***H01Q 21/00*** | (2006.01) |

(52) U.S. Cl.

CPC ..... *H01Q 1/002* (2013.01); *H01Q 1/48* (2013.01); *H01Q 1/526* (2013.01); *H01Q 3/40* (2013.01); *H01Q 21/0075* (2013.01); *H01Q 25/00* (2013.01)

(56) References Cited

FOREIGN PATENT DOCUMENTS

| | | | |
|---|---|---|---|
| CN | 201504235 | U | 6/2010 |
| CN | 102760975 | A | 10/2012 |
| CN | 103050772 | A | 4/2013 |
| CN | 102257674 | B | 3/2014 |
| CN | 105390824 | A | 3/2016 |
| WO | 2012/106021 | A1 | 8/2012 |

OTHER PUBLICATIONS

Extended European Search Report, dated Sep. 10, 2018, in European Application No. 16874809.3 (10 pp.).

International Search Report dated Mar. 2, 2017 in corresponding International Patent Application No. PCT/CN2016/109551.

International Search Report dated Mar. 2, 2017 in corresponding International Patent Application No. PCT/CN2016/109551, 4 pgs.

FEEDING NETWORK OF DUAL-BEAM ANTENNA AND DUAL-BEAM ANTENNA

CROSS-REFERENCE TO RELATED APPLICATIONS

This application is a continuation of International Application No. PCT/CN2016/109551, filed on Dec. 13, 2016, which claims priority to Chinese Patent Application No. 201510923138.3, filed on Dec. 14, 2015. The disclosures of the aforementioned applications are hereby incorporated by reference in their entireties.

TECHNICAL FIELD

Embodiments of this disclosure relate to the communications field, and in particular, to a feeding network of a dual-beam antenna and a dual-beam antenna.

BACKGROUND

As a mobile broadband (MBB) develops and a quantity of users increases, a network capacity is becoming a bottleneck of development of a universal mobile communications system (UMTS). A common manner of expanding the network capacity mainly focuses on networking with the addition of a spectrum, a station, or multiple sectors, or using of a dual-beam antenna. A quantity of main device channels is increased in the dual-beam antenna to increase a quantity of partitions of service information channels in terms of a vertical dimension, so as to improve spectral efficiency, and further increase the network capacity.

When a dual-beam antenna is applied to a Long Term Evolution (LTE) technology, a radio-frequency system of a base station has an increasingly high requirement for a technology of a base station antenna, and in particular, for passive inter-modulation (PIM). PIM is an inter-modulation effect caused because passive components such as a joint, a feeder, an antenna, and a filter are non-linear when these components work in a case of a multi-carrier high-power signal. It is usually considered that passive devices are linear. However, the passive devices are non-linear to different extents in a high-power state. Such non-linearity is mainly caused because a joint of the passive devices is not tight, or the like. Due to the non-linearity of these passive devices, higher-order harmonic waves relative to an operating frequency are generated. These harmonic waves mix with the operating frequency to generate a new set of frequencies, and finally generate a set of unwanted spectrums in the air. Consequently, normal communication is affected.

Currently, in design of a base station antenna, a bridge in a splitting network circuit usually uses a microstrip structure in a printed circuit board (PCB), and a phase-shift circuit usually uses a strip line structure on the PCB. The splitting network circuit and the phase-shift circuit are usually separated, and often cascaded in a manner of cable welding or screw connection. FIG. 1 is a schematic block diagram of a manner of connection between a splitting network circuit and a phase-shift circuit in a feeding network of a dual-beam antenna. Such a cascading manner increases a quantity of passive components, and there are risks such as a loose joint of passive components. Consequently, a PIM indicator of the dual-beam antenna is affected.

SUMMARY

Embodiments of this application provide a feeding network of a dual-beam antenna and a dual-beam antenna, so as to simplify a feeding network structure of a dual-beam antenna, and improve PIM reliability of an antenna system.

According to a first aspect, a feeding network of a dual-beam antenna is provided, including: a cavity, including an upper grounding metal plate and a lower grounding metal plate; a PCB, disposed inside the cavity, where a splitting network circuit and a phase-shift circuit in the feeding network are integrated into the PCB, and arrangement of the PCB and the cavity enables a wire on the PCB to have a strip line structure as a whole; and at least two radio-frequency signal input ports, where the at least two radio-frequency signal input ports are connected to the splitting network circuit on the PCB, and after sequentially passing through the splitting network circuit and the phase-shift circuit on the PCB, radio-frequency signals that are input from the at least two radio-frequency signal input ports form, by using an antenna element of the dual-beam antenna, at least two beams between which there is an angle.

With reference to the first aspect, in an implementation of the first aspect, the at least two radio-frequency signal input ports include a first radio-frequency signal input port and a second radio-frequency signal input port; and the splitting network circuit includes: a 90-degree bridge, where an input end of the 90-degree bridge is connected to the first radio-frequency signal input port; a power splitter, where an input end of the power splitter is connected to the second radio-frequency signal input port; a first 180-degree bridge, where a first input port of the first 180-degree bridge is connected to a first output port of the 90-degree bridge, a second input port of the first 180-degree bridge is connected to a first output port of the power splitter, and the first 180-degree bridge is connected to the phase-shift circuit; and a second 180-degree bridge, where a first input port of the second 180-degree bridge is connected to a second output port of the 90-degree bridge, a second input port of the second 180-degree bridge is connected to a second output port of the power splitter, and the second 180-degree bridge is connected to the phase-shift circuit.

With reference to any one of the first aspect or the foregoing implementation of the first aspect, in another implementation of the first aspect, an isolation end of the 90-degree bridge is grounded.

With reference to any one of the first aspect or the foregoing implementations of the first aspect, in another implementation of the first aspect, the power splitter is a power splitter that has an open-circuit stub.

With reference to any one of the first aspect or the foregoing implementations of the first aspect, in another implementation of the first aspect, a length of the open-circuit stub ranges from ⅛ of an operating wavelength to ½ of the operating wavelength.

With reference to any one of the first aspect or the foregoing implementations of the first aspect, in another implementation of the first aspect, at least one of the 90-degree bridge, the first 180-degree bridge, or the second 180-degree bridge is implemented on the PCB in a broadside coupling manner.

With reference to any one of the first aspect or the foregoing implementations of the first aspect, in another implementation of the first aspect, a sliding medium is disposed between the phase-shift circuit on the PCB and the upper grounding metal plate and/or the lower grounding metal plate, and phase shift by the phase-shift circuit is implemented by sliding the sliding medium.

With reference to any one of the first aspect or the foregoing implementations of the first aspect, in another implementation of the first aspect, there is a gap between the splitting network circuit on the PCB and each of the upper grounding metal plate and the lower grounding metal plate.

With reference to any one of the first aspect or the foregoing implementations of the first aspect, in another implementation of the first aspect, the cavity is an extruded cavity.

According to a second aspect, a dual-beam antenna is provided, where the dual-beam antenna includes the feeding network according to any one of the foregoing implementations, and the dual-beam antenna further includes: an antenna element, connected to the feeding network, where after passing through the feeding network and the antenna element, radio-frequency signals that are input into the dual-beam antenna form at least two beams between which there is an angle.

The splitting network circuit and the phase-shift circuit in the feeding network of the dual-beam antenna are integrated into the PCB by using a strip line structure. Therefore, a feeding network structure of the dual-beam antenna is simplified, a hidden PIM danger caused by connecting the splitting network circuit and the phase-shift circuit by means of soldering or by using a screw is reduced, and PIM reliability of an antenna system is improved.

DESCRIPTION OF EMBODIMENTS

The following describes technical solutions in embodiments of this application with reference to accompanying drawings.

Figure 1:
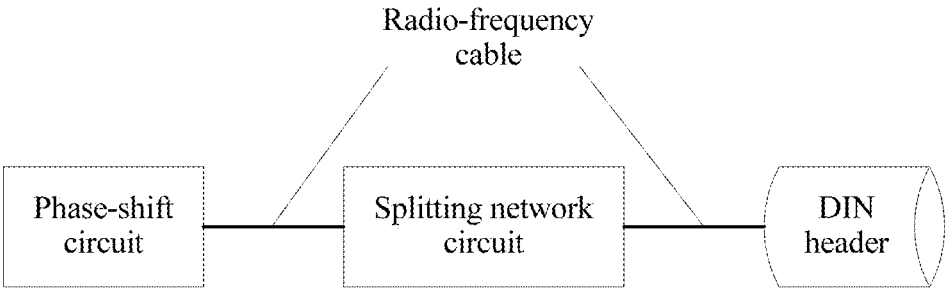
FIG. 1 is a schematic block diagram of a manner of connection between a splitting network circuit and a phase-shift circuit in a feeding network of a dual-beam antenna.
Figure 2:
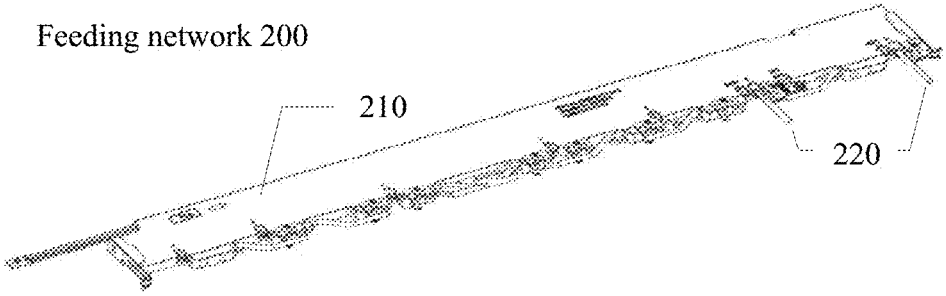
FIG. 2 is a schematic diagram of a feeding network of a dual-beam antenna according to an embodiment of this application.

FIG. 2 is a schematic diagram of a feeding network of a dual-beam antenna according to an embodiment of this application. A feeding network 200 shown in FIG. 2 includes a cavity 210, a PCB (not shown in FIG. 2), and at least two radio-frequency signal input ports 220. The cavity 210 includes an upper grounding metal plate and a lower grounding metal plate. The printed circuit board PCB is disposed inside the cavity. A splitting network circuit and a phase-shift circuit in the feeding network are integrated into the PCB. Arrangement of the PCB and the cavity 210 enables a wire on the PCB to have a strip line structure as a whole. The at least two radio-frequency signal input ports 220 are connected to the splitting network circuit on the PCB. After sequentially passing through the splitting network circuit and the phase-shift circuit on the PCB, radio-frequency signals that are input from the at least two radio-frequency signal input ports form, by using an antenna element of the dual-beam antenna, at least two beams between which there is an angle.

The splitting network circuit and the phase-shift circuit in the feeding network of the dual-beam antenna are integrated into the PCB by using a strip line structure. Therefore, a feeding network structure of the dual-beam antenna is simplified, a hidden PIM danger caused by connecting the splitting network circuit and the phase-shift circuit by means of soldering or by using a screw is reduced, and PIM reliability of an antenna system is improved.

Figure 3:
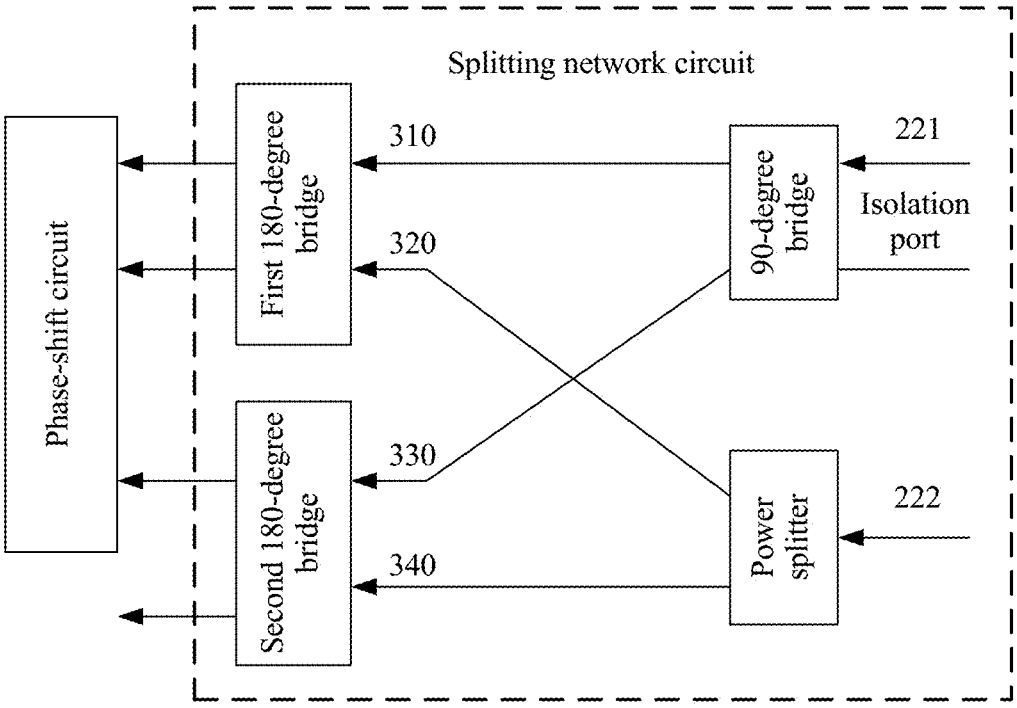
FIG. 3 is a schematic block diagram of a feeding network of a dual-beam antenna according to an embodiment of this application.

Optionally, in an embodiment, FIG. 3 is a schematic block diagram of a feeding network of a dual-beam antenna. As shown in FIG. 3, the at least two radio-frequency signal input ports 220 include a first radio-frequency signal input port 221 and a second radio-frequency signal input port 222. The splitting network circuit includes: a 90-degree bridge, where an input end of the 90-degree bridge is connected to the first radio-frequency signal input port 221; a power splitter, where an input end of the power splitter is connected to the second radio-frequency signal input port 222; a first 180-degree bridge, where a first input port 310 of the first 180-degree bridge is connected to a first output port of the 90-degree bridge, a second input port 320 of the first 180-degree bridge is connected to a first output port of the power splitter, and the first 180-degree bridge is connected to the phase-shift circuit; and a second 180-degree bridge, where a first input port 330 of the second 180-degree bridge is connected to a second output port of the 90-degree bridge, a second input port 340 of the second 180-degree bridge is connected to a second output port of the power splitter, and the second 180-degree bridge is connected to the phase-shift circuit.

For example, if a first radio-frequency signal with a phase of 0 degree is input into the input end of the 90-degree bridge, a third radio-frequency signal with a phase of 0 degree and a fourth radio-frequency signal with a phase of 90 degrees may be generated. If the third radio-frequency signal is input into the first input port (that is, a delta port) of the first 180-degree bridge, two equi-amplitude signals (that is, equi-amplitude phase-inverted signals) may be generated, that is, a signal with a phase of 0 degree and a signal with a phase of 180 degrees. If the fourth radio-frequency signal is input into the first input port (that is, a delta port) of the second 180-degree bridge, two equi-amplitude signals (that is, equi-amplitude phase-inverted signals) may be generated, that is, a signal with a phase of 90 degrees and a signal with a phase of 270 degrees. If a second radio-frequency signal is input into the input port of the power splitter, equi-amplitude in-phase signals may be generated, that is, a fifth radio-frequency signal and a sixth radio-frequency signal. If the fifth radio-frequency signal is input into the second input port (that is, a sum port) of the first 180-degree bridge, two equi-amplitude in-phase signals may be generated. If the sixth radio-frequency signal is input into the second input port (that is, a sum port) of the second 180-degree bridge, two equi-amplitude in-phase signals may be generated.

It should be understood that, the foregoing four equi-amplitude radio-frequency signals with a phase difference of 90 degrees and the foregoing four equi-amplitude in-phase radio-frequency signals may be simultaneously generated by the splitting network circuit. A sequence for generating the foregoing radio-frequency signals is not specifically limited in this embodiment of this application.

Specifically, in the feeding network of the dual-beam antenna shown in FIG. 3, one of two output ports of the second 180-degree bridge may be unconnected to the phase-shift circuit and directly output a radio-frequency signal. A phase of the radio-frequency signal that is output from the output port may be used as a reference phase when the phase-shift circuit adjusts downtilt angles of a first beam and a second beam that are formed on an element of the dual-beam antenna.

It should be further understood that, in the splitting network circuit, an output port that is of a 180-degree bridge and directly outputs a radio-frequency signal without using the phase-shift circuit may be any one of two output ports of the first 180-degree bridge and the two output ports of the second 180-degree bridge.

Figure 4:
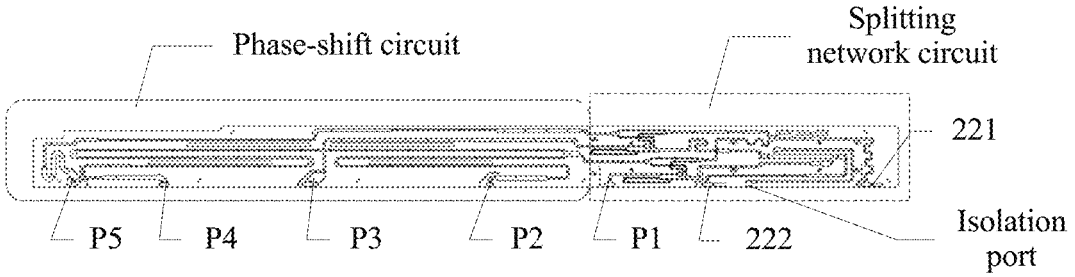
FIG. 4 is a schematic diagram of a feeding network circuit according to an embodiment of this application.
Figure 5:
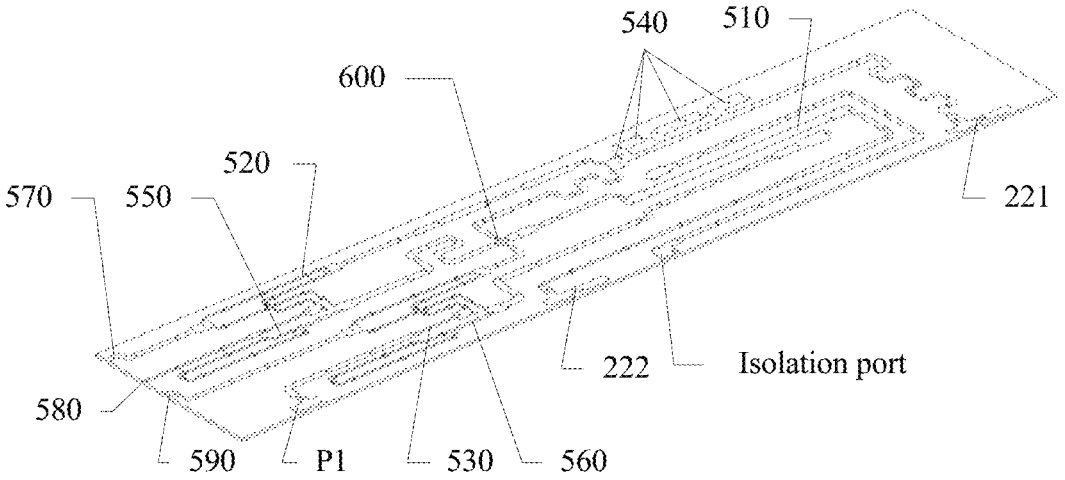
FIG. 5 is a schematic diagram of a splitting network circuit of a feeding network according to an embodiment of this application.

Another embodiment of this application is described in the following with reference to FIG. 4 and FIG. 5 and a specific scenario. FIG. 4 is a schematic diagram of a feeding network circuit according to an embodiment of this application. FIG. 5 is a schematic diagram of a splitting network circuit of a feeding network according to this embodiment of this application. In FIG. 4 and FIG. 5, a part the same as or similar to that in FIG. 2 is represented by a same reference numeral. As shown in FIG. 5, the feeding network includes the splitting network circuit and a phase-shift circuit. After a first radio-frequency signal is input from an input port 222 of the splitting network circuit and passes through a 90-degree bridge 510, two equi-amplitude radio-frequency signals with a phase difference of 90 degrees are generated and are respectively input into a delta port 520 of a first 180-degree bridge and a delta port 530 of a second 180-degree bridge. After a second radio-frequency signal is input from an input port 221 of the splitting network circuit and passes through a power splitter 540 that has a filter open-circuit stub, two equi-amplitude in-phase radio-frequency signals are generated and are respectively input into a sum port 550 of the first 180-degree bridge and a sum port 560 of the second 180-degree bridge. A first output port 570 of the first 180-degree bridge, a second output port 580 of the first 180-degree bridge, and a first output port 590 of the second 180-degree bridge are connected to the phase-shift circuit (refer to FIG. 4). A second output port P1 of the second 180-degree bridge directly outputs a radio-frequency signal without using the phase-shift circuit.

In the phase-shift circuit of the feeding network of a dual-beam antenna shown in FIG. 4, a first outbound interface of the second 180-degree bridge is connected to a power splitter in the phase-shift circuit. A radio-frequency signal that is output from the first outbound interface of the second 180-degree bridge may be split into two equi-amplitude in-phase radio-frequency signals, and the two equi-amplitude in-phase radio-frequency signals are output from output ports P2 and P4 of the phase-shift circuit after phase shifting is performed on the two signals by the phase-shift circuit.

Figure 6:
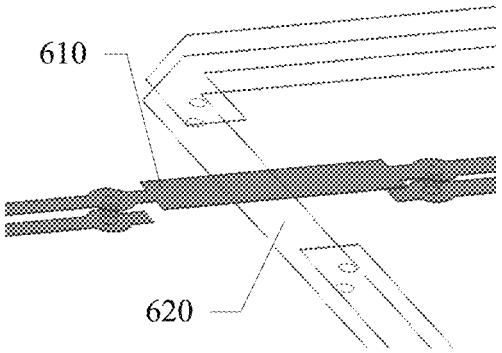
FIG. 6 is a schematic diagram of a crossing structure of strip transmission lines in a feeding network according to an embodiment of this application.

It should be further noted that, FIG. 6 is a schematic diagram of a crossing structure of strip transmission lines in a feeding network. As shown in FIG. 6, in a splitting network circuit of the feeding network, when strip line crossing 600 exists in strip transmission lines for transmitting radio-frequency signals in the circuit, single-sided strip transmission lines may be deployed for two radio-frequency signals, to avoid interference between circuit strip lines. That is, a metal strip line 610 may be deployed on an upper surface of a PCB, and a metal strip line 620 may be deployed on a lower surface of the PCB.

Optionally, in an embodiment, transmission lines on the PCB may include a metal strip line at an upper layer and a metal strip line at a lower layer of the PCB. The metal strip line at the upper layer and the metal strip line at the lower layer may be connected by using a metal via hole. Therefore, the metal strip line at the upper layer and the metal strip line at the lower layer may be regarded as one strip line. According to such a cabling manner, costs of the feeding network are reduced, and a weight of the PCB is lightened.

Figure 7:
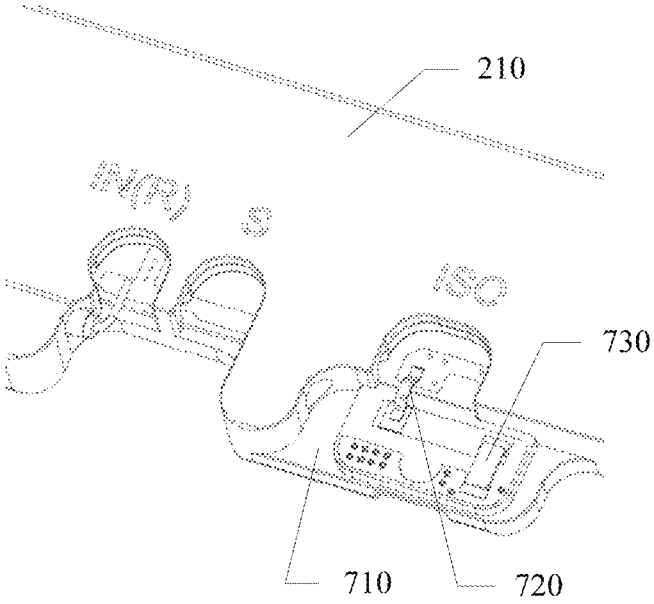
FIG. 7 is a schematic diagram of a grounding manner of an isolation port of a 90-degree bridge according to an embodiment of this application.

Optionally, in an embodiment, an isolation end of the 90-degree bridge is grounded. FIG. 7 is a schematic diagram of a grounding manner of an isolation port of a 90-degree bridge according to an embodiment of this application. In FIG. 7, a part the same as or similar to that in FIG. 2 is represented by a same reference numeral. As shown in FIG. 7, a PCB in a cavity 210 and a PCB 710 for coupling and grounding are connected by using a metal sheet 720. The PCB 710 for coupling and grounding is isolated from the cavity 210. The cavity 210 is coupled with the PCB 710 for coupling and grounding to implement grounding of the isolation port (refer to an ISO port in FIG. 7).

Optionally, in an embodiment, the power splitter may be a power splitter that has an open-circuit stub.

Optionally, in an embodiment, a length of the open-circuit stub may range from ⅛ of an operating wavelength to ½ of the operating wavelength.

Figure 8:
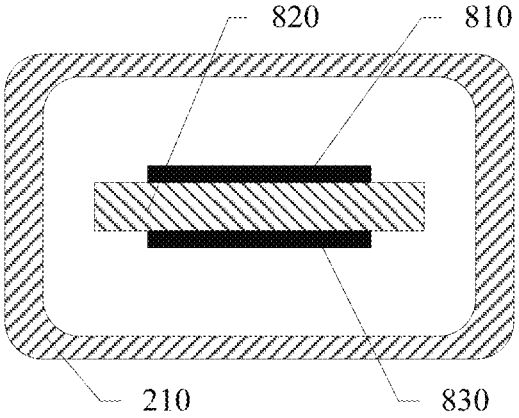
FIG. 8 is a schematic structural diagram of a 90-degree bridge implemented in a broadside coupling manner according to an embodiment of this application.

Optionally, in an embodiment, at least one of the 90-degree bridge, the first 180-degree bridge, or the second 180-degree bridge is implemented on the PCB in a broadside coupling manner. A structure of a 90-degree bridge is specifically described in the following with reference to FIG. 8 to FIG. 10. FIG. 8 is a schematic structural diagram of a 90-degree bridge implemented in a broadside coupling manner. In FIG. 8, a part the same as or similar to that in FIG. 2 is represented by a same reference numeral. As shown in FIG. 8, a first strip line copper foil 810 is on an upper surface of a PCB 820, and a second strip line copper foil 830 is on a lower surface of the PCB 820. The first strip line copper foil 810 may transfer energy to the second strip line copper foil 830 in a coupling manner, to implement broadside coupling of the 90-degree bridge.

Figure 9:
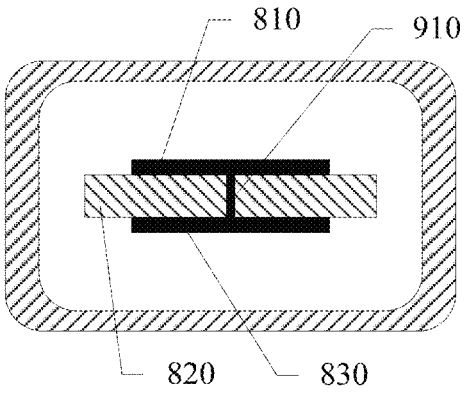
FIG. 9 is a schematic structural diagram of a 90-degree bridge according to an embodiment of this application.

FIG. 9 is a schematic structural diagram of a 90-degree bridge according to an embodiment of this application. In FIG. 9, a part the same as or similar to that in FIG. 8 is represented by a same reference numeral. The first strip line copper foil 810 and the second strip line copper foil 830 on an output port of the 90-degree bridge may be connected by using a via hole 910. Therefore, energy on the first strip line copper foil 810 may be transmitted to the second strip line copper foil 830 by using the via hole 910.

Figure 10:
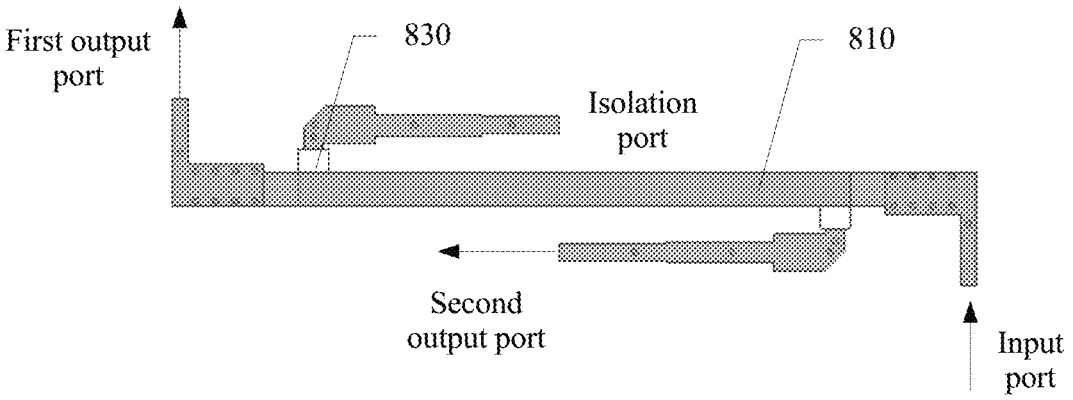
FIG. 10 is a schematic planar diagram of a 90-degree bridge implemented in a broadside coupling manner according to an embodiment of this application.

Specifically, FIG. 10 is a schematic planar diagram of a 90-degree bridge implemented in a broadside coupling manner. In FIG. 10, a part the same as or similar to that in FIG. 8 is represented by a same reference numeral. As shown in FIG. 10, a first radio-frequency signal may be input into the 90-degree bridge from an input port. A first output port may be a straight-through port of the 90-degree bridge, that is, a radio-frequency signal that is output from the first output port and the first radio-frequency signal are the same in amplitude and phase. A second output port may be a coupling port of the 90-degree bridge, and a phase difference between a radio-frequency signal that is output from the second output port and the first radio-frequency signal is 90 degrees. An ISO port may be an isolation port of the 90-degree bridge.

Optionally, in an embodiment, a sliding medium is disposed between the phase-shift circuit on the PCB and the upper grounding metal plate and/or the lower grounding metal plate, and phase shift by the phase-shift circuit is implemented by sliding the sliding medium.

Figure 11:
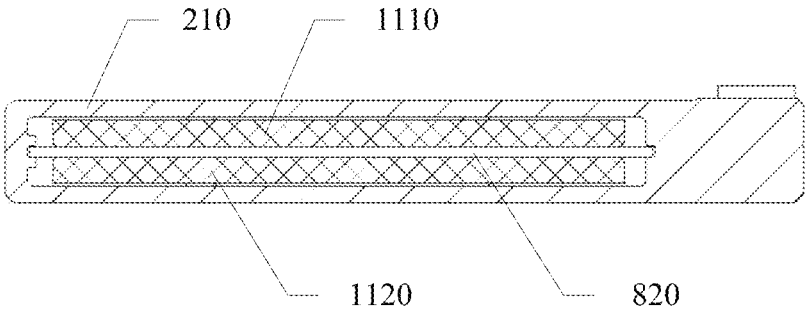
FIG. 11 is a schematic structural diagram of a phase-shift circuit according to an embodiment of this application.

Specifically, FIG. 11 is a schematic structural diagram of a phase-shift circuit. In FIG. 11, a part the same as or similar to that in FIG. 8 is represented by a same reference numeral. As shown in FIG. 11, a medium 1110 is filled between a transmission line of the phase-shift circuit and the upper grounding metal plate of the cavity 210, and a medium 1120 is filled between the transmission line of the phase-shift circuit and the lower ground metal plate of the cavity 210. Phases of radio-frequency signals that are output from output ports of the phase-shift circuit may be changed by pulling the medium 1110 and/or the medium 1120 to slide on the transmission line of the phase-shift circuit.

Optionally, in an embodiment, there is a gap between the splitting network circuit on the PCB and each of the upper grounding metal plate and the lower grounding metal plate.

Optionally, in an embodiment, the cavity is an extruded cavity.

Figure 12:
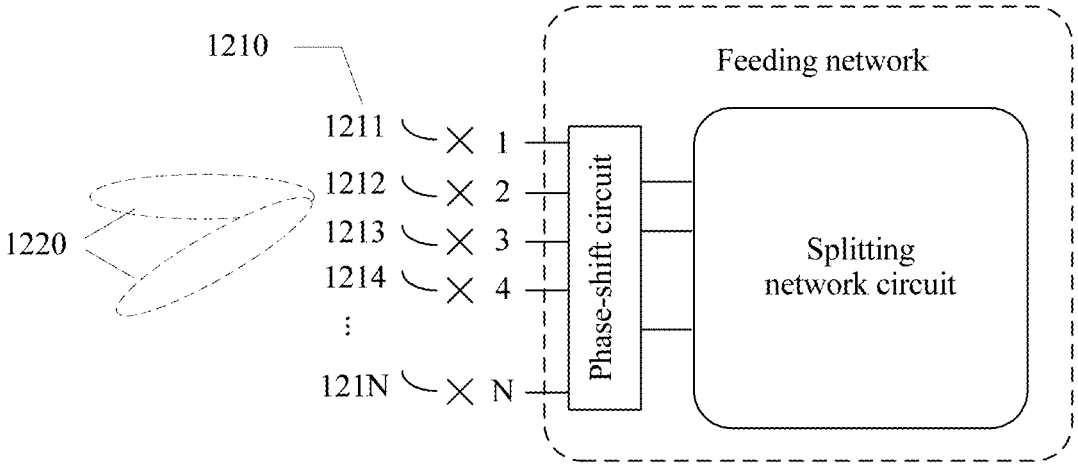
FIG. 12 is a schematic block diagram of a dual-beam antenna according to an embodiment of this application.

FIG. 12 is a schematic block diagram of a dual-beam antenna according to an embodiment of this application. The dual-beam antenna 1200 in FIG. 12 includes the feeding network shown in FIG. 2. To avoid repetition, details are not described herein again. The dual-beam antenna further includes an antenna element 1210 connected to the feeding network. After passing through the feeding network and the antenna element, radio-frequency signals that are input to the dual-beam antenna form at least two beams 1220 between which there is an angle.

The splitting network circuit and the phase-shift circuit in the feeding network of the dual-beam antenna are integrated into the PCB by using a strip line structure. Therefore, a feeding network structure of the dual-beam antenna is simplified, a hidden PIM danger caused by connecting the splitting network circuit and the phase-shift circuit by means of soldering or by using a screw is reduced, and PIM reliability of an antenna system is improved.

It should be understood that in the embodiments of this application, "B corresponding to A" indicates that B is associated with A, and B may be determined according to A. However, it should further be understood that determining A according to B does not mean that B is determined according to A only; that is, B may also be determined according to A and/or other information.

It should be understood that the term "and/or" in this specification describes only an association relationship for describing associated objects and represents that three relationships may exist. For example, A and/or B may represent the following three cases: Only A exists, both A and B exist, and only B exists. In addition, the character "/" in this specification generally indicates an "or" relationship between the associated objects.

It should be understood that sequence numbers of the foregoing processes do not mean execution sequences in various embodiments of this application. The execution sequences of the processes should be determined according to functions and internal logic of the processes, and should not be construed as any limitation on the implementation processes of the embodiments of this application.

A person of ordinary skill in the art may be aware that, in combination with the examples described in the embodiments disclosed in this specification, units and algorithm steps can be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of this application.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in this application, it should be understood that the disclosed system, apparatus, and method may be implemented in other manners. For example, the described apparatus embodiment is merely an example. For example, the unit division is merely logical function division and may be other division in actual implementation. For example, multiple units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on multiple network units. Some or all of the units may be selected according to actual requirements to achieve the objectives of the solutions of the embodiments.

In addition, functional units in the embodiments of this application may be integrated into one processing unit, or each of the units may exist alone physically, or two or more units may be integrated into one unit.

When the functions are implemented in the form of a software functional unit and sold or used as an independent product, the functions may be stored in a computer-readable storage medium. Based on such an understanding, the technical solutions of this application essentially, or the part contributing to the prior art, or some of the technical solutions may be implemented in a form of a software product. The software product is stored in a storage medium, and includes several instructions for instructing a computer device (which may be a personal computer, a server, a network device, or the like) to perform all or some of the steps of the methods described in the embodiments of this application. The foregoing storage medium includes: any medium that can store program code, such as a USB flash drive, a removable hard disk, a read-only memory (ROM), a random access memory (RAM), a magnetic disk, or an optical disc.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A feeding network of a dual-beam antenna, comprising:

a cavity, comprising an upper grounding metal plate and a lower grounding metal plate;

a printed circuit board (PCB), disposed inside of the cavity, the PCB comprising:

a splitting network circuit configured in strip line, and a phase-shift circuit configured in strip line; and at least two radio-frequency signal input ports connected to the splitting network circuit on the PCB, and after sequentially passing through the splitting network circuit and the phase-shift circuit on the PCB, radio-frequency signals that are input from the at least two radio-frequency signal input ports form, by using an antenna element of the dual-beam antenna, at least two beams between which there is an angle, wherein the at least two radio-frequency signal input ports comprise a first radio-frequency signal input port and a second radio-frequency signal input port, and the splitting network circuit comprises:

a 90-degree bridge, wherein an input port of the 90-degree bridge is connected to the first radio-frequency signal input port;

a power splitter, wherein an input port of the power splitter is connected to the second radio-frequency signal input port; and a first 180-degree bridge and a second 180-degree bridge each of which is connected to the 90-degree bridge, the power splitter, and the phase-shift circuit, respectively.

2. The feeding network according to claim 1, wherein a first input port of the first 180-degree bridge is connected to a first output port of the 90-degree bridge, a second input port of the first 180-degree bridge is connected to a first output port of the power splitter, and the first 180-degree bridge is connected to the phase-shift circuit; and wherein a first input port of the second 180-degree bridge is connected to a second output port of the 90-degree bridge, a second input port of the second 180-degree bridge is connected to a second output port of the power splitter, and the second 180-degree bridge is connected to the phase-shift circuit.

3. The feeding network according to claim 2, wherein an isolation end of the 90-degree bridge is grounded.

4. The feeding network according to claim 2, wherein the power splitter includes an open-circuit stub.

5. The feeding network according to claim 4, wherein a length of the open-circuit stub ranges from ⅛ of an operating wavelength to ½ of the operating wavelength.

6. The feeding network according to claim 1, wherein at least one of the 90-degree bridge, the first 180-degree bridge, or the second 180-degree bridge is implemented on the PCB in broadside coupling.

7. The feeding network according to claim 1, wherein a sliding medium is disposed between the phase-shift circuit on the PCB and the upper grounding metal plate and/or the lower grounding metal plate, and phase shift by the phase-shift circuit is implemented by sliding the sliding medium.

8. The feeding network according to claim 1, wherein there is a gap between the splitting network circuit on the PCB and each of the upper grounding metal plate and the lower grounding metal plate.

9. The feeding network according to claim 1, wherein the cavity is an extruded cavity.

10. A dual-beam antenna, comprising:

a feeding network, comprising:

a cavity, comprising an upper grounding metal plate and a lower grounding metal plate;

a printed circuit board (PCB), disposed inside of the cavity, the PCB comprising:

a splitting network circuit configured in strip line, and a phase-shift circuit configured in strip line; and at least two radio-frequency signal input ports connected to the splitting network circuit on the PCB, and after sequentially passing through the splitting network circuit and the phase-shift circuit on the PCB, radio-frequency signals that are input from the at least two radio-frequency signal input ports form, by using an antenna element of the dual-beam antenna, at least two beams between which there is an angle, wherein the at least two radio-frequency signal input ports comprise a first radio-frequency signal input port and a second radio-frequency signal input port, and the splitting network circuit comprises:

a 90-degree bridge, wherein an input port of the 90-degree bridge is connected to the first radio-frequency signal input port;

a power splitter, wherein an input port of the power splitter is connected to the second radio-frequency signal input port; and a first 180-degree bridge and a second 180-degree bridge each of which is connected to the 90-degree bridge, the power splitter, and the phase-shift circuit, respectively; and the antenna element, connected to the feeding network, wherein after passing through the feeding network and the antenna element, radio-frequency signals that are input into the dual-beam antenna form at least two beams between which there is an angle.

11. The dual-beam antenna according to claim 10, wherein a first input port of the first 180-degree bridge is connected to a first output port of the 90-degree bridge, a second input port of the first 180-degree bridge is connected to a first output port of the power splitter, and the first 180-degree bridge is connected to the phase-shift circuit; and wherein a first input port of the second 180-degree bridge is connected to a second output port of the 90-degree bridge, a second input port of the second 180-degree bridge is connected to a second output port of the power splitter, and the second 180-degree bridge is connected to the phase-shift circuit.

12. The dual-beam antenna according to claim 11, wherein an isolation end of the 90-degree bridge is grounded.

13. The dual-beam antenna according to claim 11, wherein the power splitter includes an open-circuit stub.

14. The dual-beam antenna according to claim 13, wherein a length of the open-circuit stub ranges from ⅛ of an operating wavelength to ½ of the operating wavelength.

15. The dual-beam antenna according to claim 10, wherein at least one of the 90-degree bridge, the first 180-degree bridge, or the second 180-degree bridge is implemented on the PCB in broadside coupling.

16. The dual-beam antenna according to claim 10, wherein a sliding medium is disposed between the phase-shift circuit on the PCB and the upper grounding metal plate and/or the lower grounding metal plate, and phase shift by the phase-shift circuit is implemented by sliding the sliding medium.

17. The dual-beam antenna according to claim 10, wherein there is a gap between the splitting network circuit on the PCB and each of the upper grounding metal plate and the lower grounding metal plate.

18. The dual-beam antenna according to claim 10, wherein the cavity is an extruded cavity.

* * * * *